US012686540B2

(12) United States Patent
Ruggiero

(10) Patent No.: US 12,686,540 B2
(45) Date of Patent: Jul. 21, 2026

(54) REUSABLE BOTTLE CAP WITH GOLF TEE

(71) Applicant: Stroke & Distance LLC, Turnersville, NJ (US)

(72) Inventor: Jonathan Ruggiero, Turnersville, NJ (US)

(73) Assignee: Stroke & Distance LLC, Turnersville, NJ (US)

( * ) Notice: Subject to any disclaimer, the term of this patent is extended or adjusted under 35 U.S.C. 154(b) by 85 days.

(21) Appl. No.: 18/440,600

(22) Filed: Feb. 13, 2024

(65) Prior Publication Data

US 2024/0270456 A1 Aug. 15, 2024

Related U.S. Application Data

(60) Provisional application No. 63/484,865, filed on Feb. 14, 2023.

(51) Int. Cl.

| | |
|---|---|
| ***B65D 51/24*** | (2006.01) |
| ***A63B 57/10*** | (2015.01) |
| ***A63B 57/20*** | (2015.01) |
| ***A63B 57/30*** | (2015.01) |
| ***A63B 57/35*** | (2015.01) |
| ***B65D 41/12*** | (2006.01) |

(52) U.S. Cl.
CPC ..... *B65D 51/243* (2013.01); *A63B 57/10* (2015.10); *A63B 57/203* (2015.10); *A63B 57/35* (2015.10); *A63B 57/353* (2015.10); *B65D 41/125* (2013.01)

(58) Field of Classification Search
CPC ..... B65D 81/365; B65D 51/243; B65D 41/0421; B65D 41/0414; B65D 41/086; A63B 57/10
USPC ..... 215/200
See application file for complete search history.

(56) References Cited

U.S. PATENT DOCUMENTS

| | | | | |
|---|---|---|---|---|
| 2,850,193 | A * | 9/1958 | Wieckmann | B65D 41/185 215/320 |
| 3,335,893 | A * | 8/1967 | Hanson | B65D 41/485 215/354 |
| 5,524,788 | A * | 6/1996 | Plester | B65D 51/28 220/281 |
| 5,762,218 | A * | 6/1998 | Sachau | B65D 41/0414 215/354 |
| 5,769,263 | A * | 6/1998 | Willingham | B65D 51/28 215/6 |
| 5,782,369 | A * | 7/1998 | Tansey | B65D 41/3428 215/331 |
| 5,871,111 | A * | 2/1999 | Pfefferkorn | B65D 41/0421 215/354 |
| 5,957,316 | A * | 9/1999 | Hidding | B67D 3/0032 141/351 |

(Continued)

*Primary Examiner* — Ernesto A Grano
(74) *Attorney, Agent, or Firm* — Morgan, Lewis & Bockius LLP

(57) ABSTRACT

A reusable bottle cap includes a panel having a top surface and a bottom surface. A sidewall extends downwardly from a periphery of the panel away from the bottom surface. The sidewall is configured to engage with an outer surface of a bottle neck proximate a rim of the bottle when the reusable bottle cap is coupled to the bottle neck. A peg extends downwardly from the bottom surface of the panel and is spaced from the sidewall. The peg is configured to be spaced from an inner surface of the bottle neck when the reusable bottle cap is coupled to the bottle neck.

20 Claims, 13 Drawing Sheets

(56) References Cited

U.S. PATENT DOCUMENTS

| | | | | |
|---|---|---|---|---|
| 6,126,026 | A * | 10/2000 | Ekkert | B29C 45/26 215/354 |
| 7,909,188 | B2 * | 3/2011 | Kim | B65D 41/18 220/795 |
| 8,567,597 | B2 * | 10/2013 | Gibson | B65D 51/28 206/242 |
| 9,580,212 | B2 * | 2/2017 | Graux | B67D 3/0032 |
| 10,352,498 | B2 * | 7/2019 | Rieger | F16M 11/105 |
| 2018/0104463 | A1 * | 4/2018 | Weber | A45D 34/041 |
| 2019/0225388 | A1 * | 7/2019 | Wasso, Jr. | B65D 51/24 |
| 2020/0062458 | A1 * | 2/2020 | Luzzato | B65D 41/0414 |

* cited by examiner

REUSABLE BOTTLE CAP WITH GOLF TEE

CROSS-REFERENCE TO RELATED APPLICATIONS

This application claims the benefit of U.S. Provisional Patent Application No. 63/484,865 filed Feb. 14, 2023 entitled "Reusable Bottle Cap with Golf Tee", which is incorporated by reference herein in its entirety.

TECHNICAL FIELD

The present disclosure generally relates to a reusable bottle cap and, in some embodiments, to a reusable bottle cap with a golf tee.

SUMMARY

In one embodiment there is a reusable bottle cap including a panel having a top surface and a bottom surface, a sidewall extending downwardly from a periphery of the panel away from the bottom surface, the sidewall configured to engage with an outer surface of a bottle neck proximate a rim of the bottle when the reusable bottle cap is coupled to the bottle neck, and a peg extending downwardly from the bottom surface of the panel and spaced from the sidewall, the peg configured to be spaced from an inner surface of the bottle neck when the reusable bottle cap is coupled to the bottle neck.

In some embodiments, the sidewall extends downwardly from the bottom surface of the panel by a first distance and the peg extends downwardly from the bottom surface of the panel by a second distance that is greater than the first distance. In some embodiments, the first distance is about 0.375 inches, and the second distance is about 0.535 inches. In some embodiments, the panel extends circumferentially around a central axis and the peg extends downwardly from the bottom surface of the panel along the central axis. In some embodiments, the peg has an outer diameter that is less than an inner diameter of the sidewall. In some embodiments, the peg has an outer diameter that is equal to about 75% of an inner diameter of the sidewall.

In some embodiments, the peg is configured to receive a golf ball as a golf tee when the panel is placed on a ground surface such that the golf ball does not directly contact the sidewall. In some embodiments, the peg includes a distal end having a receiving aperture configured to detachably couple one or more golf tee attachments to the reusable bottle cap. In some embodiments, the panel, sidewall and peg are comprised of a generally flexible material. In some embodiments, the sidewall and peg form a bottle opener. In some embodiments, the peg includes a generally frustoconical recess open at a distal end of the peg and configured to receive a portion of a golf ball.

In some embodiments, the reusable bottle cap further includes a magnet fixedly coupled to the panel, the magnet configured to detachably couple the reusable bottle cap to a metallic surface. In some embodiments, the reusable bottle cap further includes a golf ball marker detachably coupled to a recess at the top surface the panel by the magnet. In some embodiments, the panel extends circumferentially around a central axis and the magnet is embedded within the panel and offset from the central axis.

In one embodiment there is a reusable bottle cap including a panel having a top surface defining a first recess and a bottom surface opposite the top surface, a ball marker detachably received within the first recess at the top surface of the panel and magnetically coupled thereto via a magnet embedded in the panel, a sidewall extending downwardly from a periphery of the panel away from the bottom surface, the sidewall configured to engage with an outer surface of a bottle neck proximate a rim of the bottle when the reusable bottle cap is coupled to the bottle neck, and a peg extending downwardly from the bottom surface of the panel and spaced from the sidewall, an outer surface of the peg spaced from an inner surface of the sidewall, the peg including a generally frustoconical recess open at a distal end of the peg and configured to receive a golf ball, and an aperture open at the recess of the peg and extending upwardly toward the top surface of the panel, the aperture configured to couple a golf tee attachment to the reusable bottle cap.

In one embodiment, there is a method of placing a golf ball on a tee, the method includes, placing a reusable bottle cap on a ground surface, the reusable bottle cap including a panel having a top surface and a bottom surface, a sidewall extending downwardly from a periphery of the panel away from the bottom surface, the sidewall configured to engage with an outer surface of a bottle neck proximate a rim of the bottle when the reusable bottle cap is coupled to the bottle neck, and a peg extending downwardly from the bottom surface of the panel and spaced from the sidewall, the peg configured to be spaced from an inner surface of the bottle neck when the reusable bottle cap is coupled to the bottle neck. The method further includes placing a golf ball on the peg such that the golf ball is elevated above the ground surface by at least 0.50 inches, and when placed on the ground surface the top surface of the panel rests on the ground surface.

BRIEF DESCRIPTION OF THE DRAWINGS

The following detailed description of embodiments of the reusable bottle cap with golf tee, will be better understood when read in conjunction with the appended drawings of an exemplary embodiment. It should be understood, however, that the invention is not limited to the precise arrangements and instrumentalities shown.

In the drawings.

DETAILED DESCRIPTION

Figure 1A:
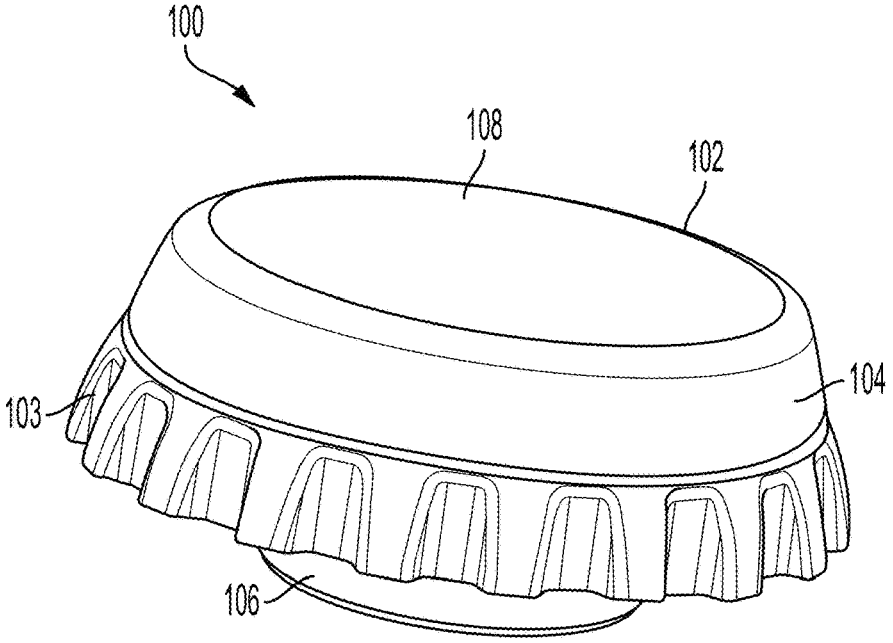
FIG. 1A is a top perspective view of a reusable bottle cap with golf tee in accordance with an exemplary embodiment of the present disclosure.

During play of golf, it is often desirable to bring capped beverage containers (e.g., a beer in a long neck beer bottle) onto the field of play. Such beverage containers are often capped using disposable or single use style bottle caps such as, but not limited to, metal crown caps, that are configured to be deformed or bent in order to be removed from the bottle. This often results in the inability to reseal the bottled beverage using the same cap after the cap has been removed. As such, the liquid contained within the beverage container may spill out of the container during transport (e.g., when being transported in a golf cart). Furthermore, the conventional caps are often designed to serve a single purpose, which is to seal the bottled beverage. Furthermore, in the play of golf, golf tees are frequently used to support a golf ball by raising it above a ground surface (e.g., when teeing off from a tee station). As such, there is a need to provide a bottle cap that is reusable to reseal a beverage container after an existing bottle cap has been removed and that is also configured to be used as a reusable golf tee.

Referring to the drawings in detail, wherein like reference numerals indicate like elements throughout, there is shown in FIGS. 1-5E a reusable bottle cap with golf tee, generally designated 100 and also referred to as bottle cap 100, in accordance with exemplary embodiments of the present disclosure. In some embodiments, the bottle cap 100 is configured to be reusable to fluidly seal the mouth of a bottle a plurality of different times. For example, the bottle cap 100 may be configured to be coupled to and decoupled from a neck of a bottle proximate the rim where the mouth is any number of times to fluidly seal the bottle and prevent a fluid contained therein from exiting through the mouth of the bottle. The bottle cap 100 may also include a peg or golf tee like structure such that the bottle cap 100 may act as a stand for supporting and elevating the golf ball above a ground surface during play of golf. In this manner, the bottle cap 100 may be reusable as a bottle cap and/or golf tee thereby reducing the amount of equipment required to be carried or transported by a player participating in play of golf. The bottle cap 100 of the present disclosure may also be beneficial in instances where a ground surface isn't suitable for inserting a conventional golf tee. For example, if the ground surface is rocky, frozen, or comprised of an artificial material (e.g., an artificial turf) a user may not be able embed a golf tee therein. However, the bottle cap 100 of the present disclosure may be configured rest on a top layer of the ground surface while supporting and elevating a golf ball above the ground surface. In some embodiments, the bottle cap 100 of the present disclosure may be configured to act as a golf swing training tool by providing a user with a consistent contact surface for the face of their golf club when swinging the club.

Figure 1B:
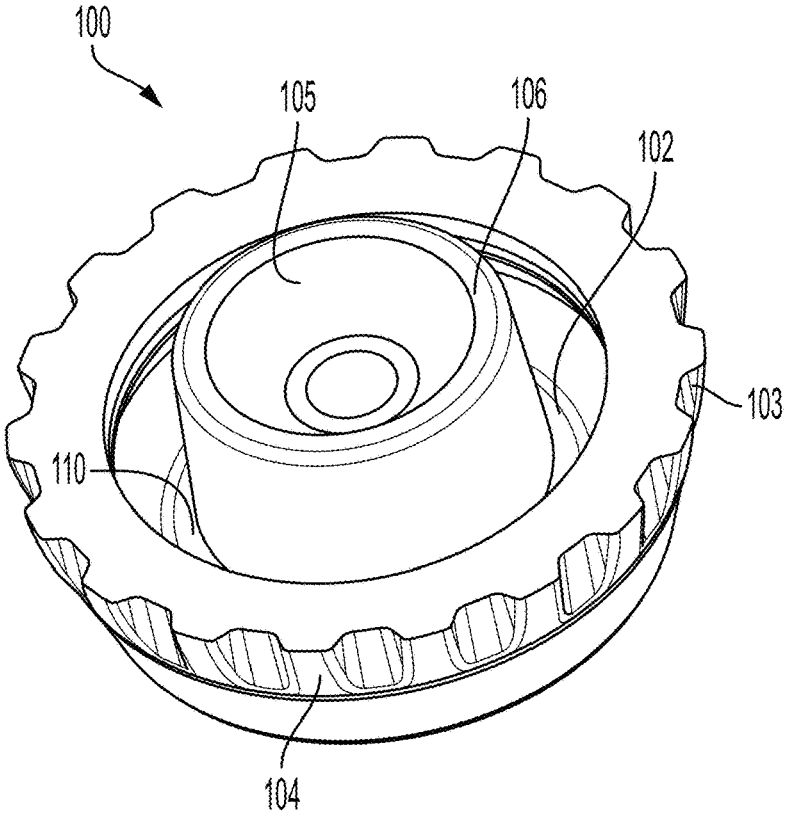
FIG. 1B is a bottom perspective view of the reusable bottle cap of FIG. 1A.

Referring to FIGS. 1A-1B, the reusable bottle cap 100 may include a panel 102, a sidewall 104 extending downwardly from the panel 102, and a peg 106 spaced from the sidewall 104 and extending downwardly from the panel 102. The sidewall 104 and/or panel 102 may be configured to detachably couple the bottle cap 100 to a bottle (e.g., a long neck bottle, bomber bottle, heritage bottle, stubby bottle) or other fluid container (e.g., a pull-tab can). The peg 106 may be configured to receive a golf ball such that the golf ball is supported by the peg 106 and elevated above a ground surface, as discussed in more detail below. The panel 102 may include a top surface 108 and a bottom surface 110 opposite the top surface 108. The sidewall 104 may extend downwardly from a periphery of the panel 102. For example, the sidewall 104 may be coupled to the periphery of the top surface 108 of the panel 102 and may extend downwardly away from the bottom surface 110 thereof. In some embodiments, the peg 106 spaced from the sidewall 104 and extends downwardly and away from the bottom surface 110 of the panel 102. The peg 106 may not directly abut the sidewall 104 such that a gap is formed between the peg 106 and the sidewall 104.

In some embodiments, the panel 102, sidewall 104, and peg 106 are integrally formed. In some embodiments, the panel 102, sidewall 104, and/or peg 106 are comprised of a flexible material (e.g., rubber, plastic). In some embodiments, one or more of the panel 102, sidewall 104, and/or peg 106 are comprised of a generally rigid material (e.g., a metal, metal alloy). For example, in some embodiments, the peg 106 may be comprised of a metal material while the sidewall 104 and/or panel 102 are comprised of a rubber or rubber-like material. In some embodiments, the sidewall 104 and peg 106 may form a bottle opener. For example, a conventional bottle cap (e.g., a metal crown cap) may be placed between the sidewall 104 and peg 106 such that a distal edge of the sidewall is abuts a bottom of the conventional bottle cap and the peg 106 abuts a top of the conventional bottle cap. As such, the peg 106 may act as a fulcrum on which to pivot the bottle cap 100 thereby causing the engagement of the sidewall 104 to bend or deform the conventional bottle cap such that it may be removed from a bottle. In such embodiments, one or more of the peg 106 and/or an inner surface of the sidewall 104 may be comprised of a generally rigid material.

In some embodiments, the peg 106 may be detachably coupled to the bottle cap 100. The bottom surface 110 of the panel 102 may be configured to detachably couple the peg 106 thereto. For example, in some embodiments, the bottom surface 110 may include a receiving aperture configured to detachably couple the peg 106 thereto. In some embodiments, the peg receiving aperture may include a magnet. In some embodiments, the peg 106 when decoupled from the panel 102 may act as a divot tool.

In some embodiments, the sidewall 104 of the bottle cap 100 includes a plurality of teeth 103 radially offset from one another along an outer surface of the sidewall 104. In some embodiments, the plurality of teeth 103 may be configured to enable a user to easily remove the bottle cap 100 from a bottle. For example, the teeth 103 may provide a larger surface, when compared to a generally flat sidewall, upon which a user's fingertips may be placed to pull the bottle cap 100 off of a bottle.

Figure 2A:
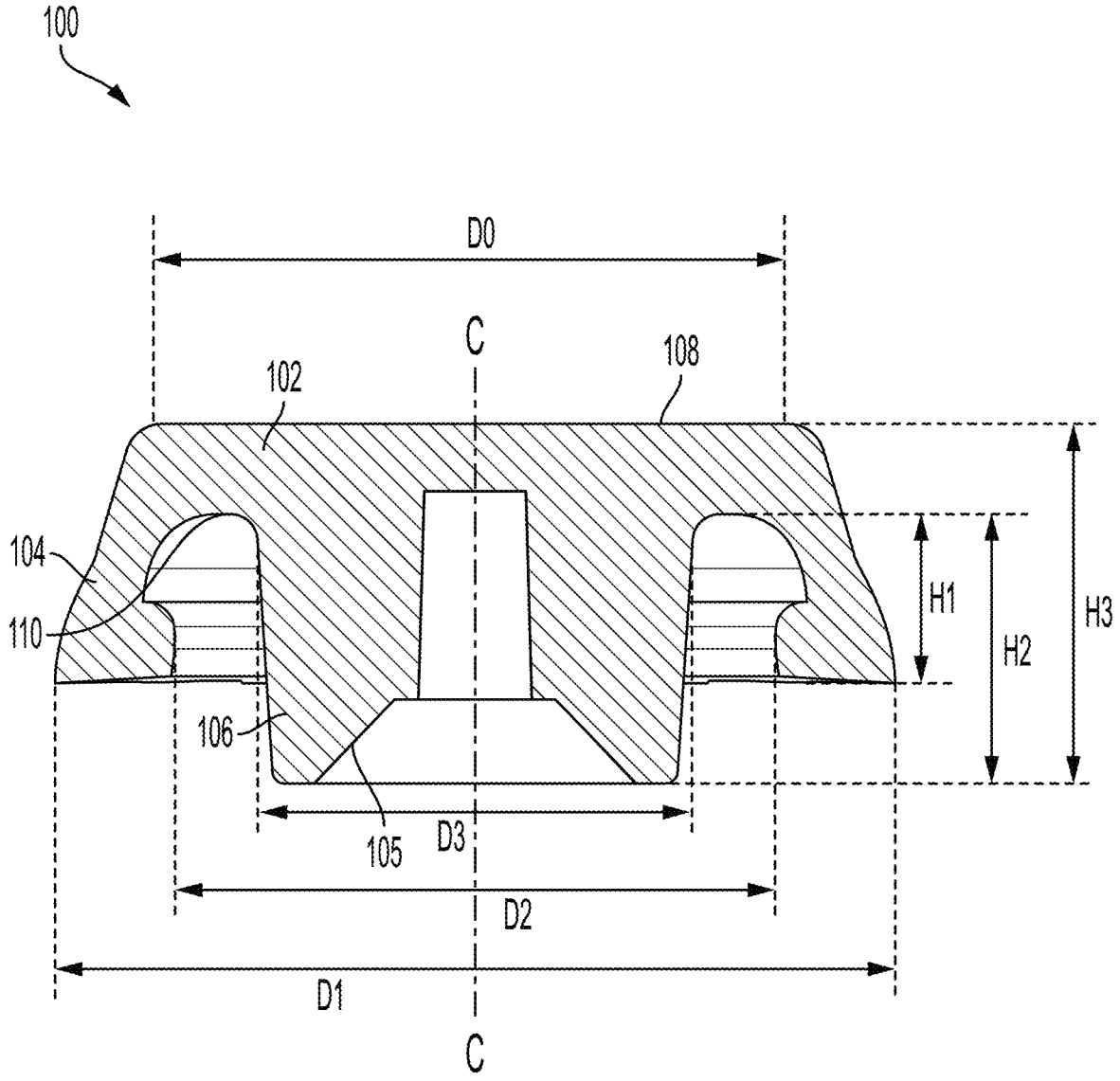
FIG. 2A is a cross-sectional view of the reusable bottle cap of FIG. 1A.
Figure 2B:
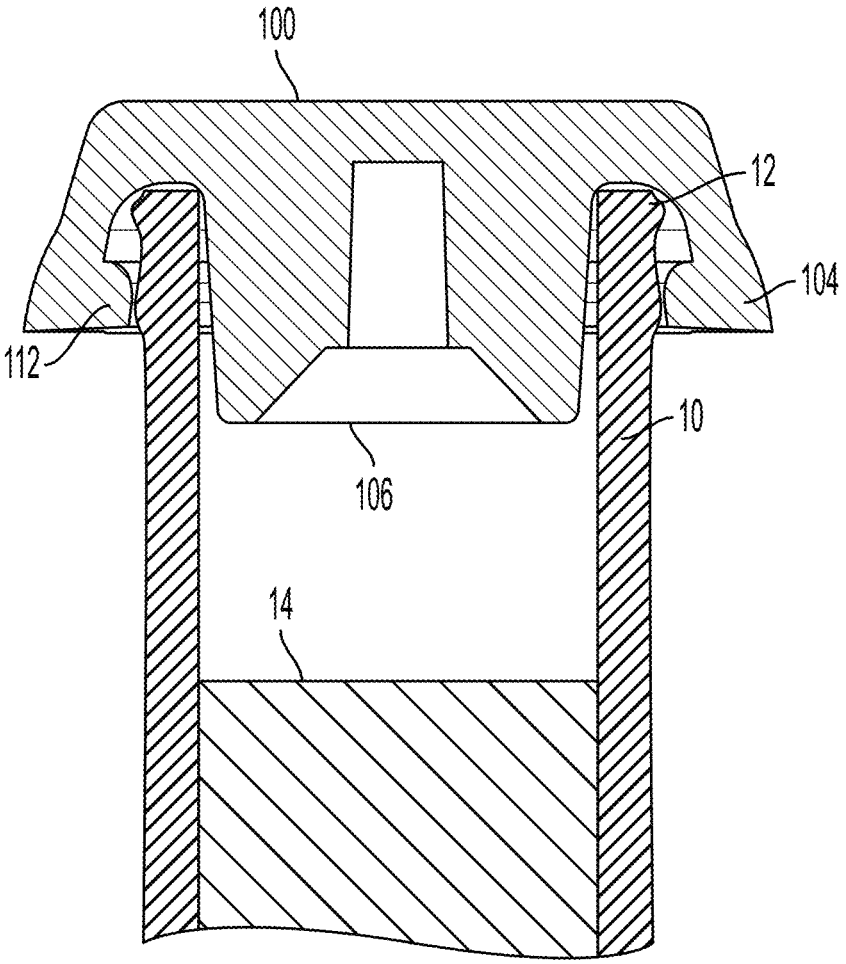
FIG. 2B is a cross-sectional view of the reusable bottle cap of FIG. 1A coupled to the rim of a bottle.

Referring to FIGS. 2A-2B, the peg 106 may extend below the sidewall 104 such that when a golf ball is mounted on the peg 106, the peg 106 may prevent the golf ball from directly contacting the sidewall 104. In some embodiments, the sidewall 104 extends downwardly from the bottom surface 110 of the panel 102 by a first distance H1 and the peg 106 extends downwardly from the bottom surface 110 by a second distance H2 that is greater than or equal to the first distance H1. In some embodiments, the second distance H2 is at least 10% greater than the first distance H1. In some embodiments, the second distance H2 is between about 10% to about 25% greater than the first distance H1. In some embodiments, the first distance H1 is about 0.240 inches and the second distance H2 is about 0.362 inches. In some embodiments, the second distance H2 is at least 0.05 inches greater than the first distance H1 In some embodiments, the second distance H2 is at least 0.100 inches greater than the first distance H1. In some embodiments, the second distance H2 is between at least 0.050 inches to about 0.120 inches greater than the first distance H1. In some embodiments, the second distance H2 is between about 25% to about 60% greater than the first distance H1. In some embodiments, the second distance H2 is about 50% greater than the first distance H1. In some embodiments, the bottle cap 100 may have a total height H3, as measured between the top surface 108 of the panel 107 and a distal end of the peg 106, of between about 0.30 inches to about 0.60 inches. In some embodiments, the height H3 is about 0.535 inches.

The panel 102 and/or sidewall 104 may be generally circular in shape when viewed from either the top or bottom of the bottle cap 100 to generally match the circular shape of conventional bottles or other beverage containers (e.g., pull-tab cans). In some embodiments, the panel 102 and/or sidewall 104 extends circumferentially around a central axis C. In some embodiments, the sidewall 104 flares outwardly from the panel 102. For example, the top surface 108 of panel 102 may have a diameter D0 that is less than a maximum outer diameter D1 of the sidewall 104. In some embodiments, the diameter D0 is between about 0.70 inches to about 1.00 inches and the maximum outer diameter D1 of the sidewall 104 may be between about 1.00 inches to about 1.50 inches. In some embodiments, the diameter D0 is about 0.90 inches and the diameter D1 is about 1.25 inches. The sidewall 104 may have an inner diameter D2 characterized by the surface of the sidewall 104 closest to the central axis C. In some embodiments, the inner diameter D2 of sidewall 104 is selected such that the sidewall 104 may engage with an outer surface of a bottle neck 10 proximate a rim 12 as illustrated in FIG. 2B. For example, the inner diameter D2 may correspond to an outer diameter of a bottle neck 10 and/or rim 12 such the sidewall 104 may at least partially abut the bottle neck 10 and/or rim 12. In some embodiments, the inner diameter D2 is about 0.90 inches. In some embodiments, the sidewall 104 includes a lip 112 extending radially inward toward the central axis C and configured to prevent accidental or unintended decoupling of the bottle cap 100 from a bottle.

The peg 106 may be configured to not contact a surface of the bottle (e.g., the bottle neck 10, rim 12), and/or a fluid (e.g., fluid 14) contained therein when the bottle cap 100 is coupled to a bottle. For example, the peg 106 may be centered on the bottom surface 110 of the panel 102 such that the peg 106 is spaced from an inner sidewall of the bottle and may extend downwardly from the bottom surface 110 by the distance H2 such that the peg 106 does not contact the fluid 14 contained within the bottle. In this manner, the peg 106, which, as discussed above, during use may have a golf ball placed directly thereon, may be configured to not directly contact any surfaces of a bottle or fluids/liquids contained within thereby reducing the risk of debris or germs on the peg 106 from being transferred to the bottle or a fluid which a user intends to drink. Additionally, the bottle cap 100 may act as a fluid seal when coupled to the rim 12 to prevent the fluid 14 contained within the bottle from accidentally spilling out. It will be understood that the bottle neck 10, rim 12 and fluid 14 illustrated in FIG. 2B are for illustrative purposes only and that there may be numerous alternative shapes, sizes and configurations of bottles and volumes of a fluid contained therein.

The peg 106 may be positioned on the bottom surface 110 of the panel 102 and extend downwardly therefrom such that the peg 106 passes freely through a mouth or fluid conduit in a fluid container. For example, in embodiments where the bottle cap 100 is configured to be coupled to a long-neck bottle, the peg 106 may be centered on and extend downwardly from the bottom surface 110 of the panel 102 along the central axis C. In other embodiments, bottle cap 100 may be configured to be coupled to a pull-tab can, wherein the opening for fluid to pass therethrough is offset from a central axis of the cylindrical can. In such instances, the peg 106 may be offset from the central axis C and extend downwardly in a generally parallel direction. For sake of brevity though, the bottle cap 100 and peg 106 will be discussed herein as though the peg 106 extends generally along the central axis C.

In some embodiments, the peg 106 may be sized such that it does not directly contact a surface of a bottle when the bottle cap 100 is coupled to. For example, the peg 106 may have a maximum outer diameter D3 that is less than an inner diameter of a bottle and/or the inner diameter D2 of the sidewall 104. In some embodiments, the outer diameter D3 of the peg 106 is less than the inner diameter D2 of the sidewall 104. In some embodiments, the outer diameter D3 of the peg 106 is less than or equal to about 75% of the inner diameter D2 of the sidewall 104. In some embodiments, the outer diameter D3 of the peg 106 is between about 0.10 inches to about 0.80 inches. In some embodiments, the outer diameter D3 is about 0.645 inches.

Figure 3:
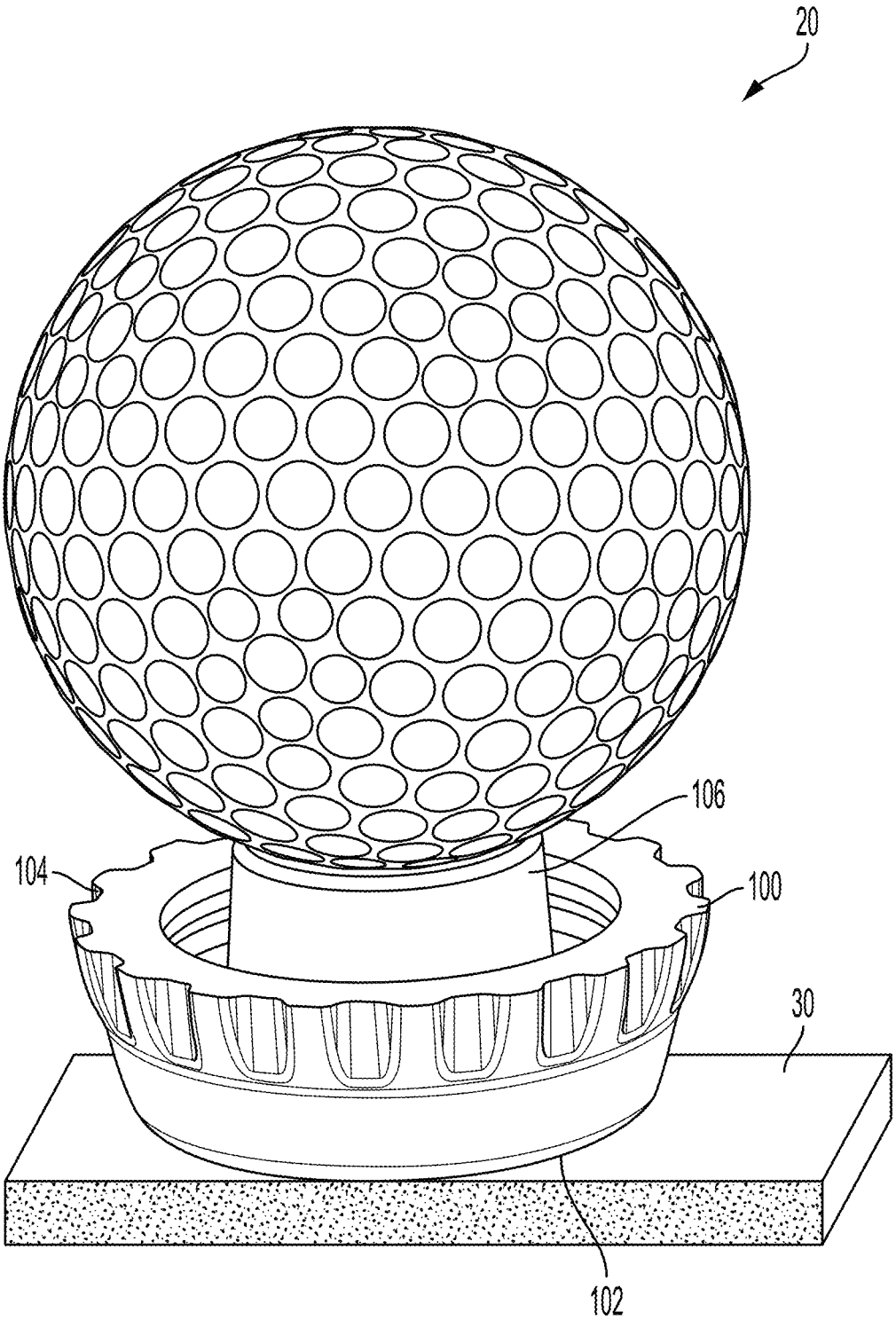
FIG. 3 is a side perspective view of the reusable bottle cap of FIG. 1A with a golf ball placed thereon.

Referring to FIG. 3, and as discussed above, in some embodiments, the peg 106 is configured to receive a golf ball (e.g., golf ball 20) such that the golf ball does not directly contact the sidewall 104 and/or panel 102. For example, and as illustrated in FIG. 3, a golf ball 20 is shown received by the peg 106 while the bottle cap 100 rests on a ground surface 30. As illustrated in FIG. 3, the golf ball 20 does not directly contact the sidewall 104 while resting on the peg 106. Additionally, the panel 102 rests on the top layer of the ground surface 30 without requiring the bottle cap 100 to penetrate the top layer of the ground surface 30. As such, the bottle cap 100 of the present disclosure may be used in instances where the ground surface 30 would otherwise be unsuitable for conventional golf tees, which require the pointed end thereof to penetrate the ground surface. For example, the bottle cap 100 may be used in instances where the ground surface 30 is frozen, rocky and/or comprised of an artificial or synthetic turf. This may be particularly beneficial in instances where a user wishes to elevate the golf ball 20 (e.g., when using a driver or wood type golf club) but the ground surface 30 is unsuitable for inserting a convention golf tee therein.

The bottle cap 100 may act as a golf tee to support and elevate the golf ball 20 above a ground surface 30 such that a player may strike the elevated ball during play of golf. As such, in some embodiments, there may be a method of placing a golf ball on a golf tee using the bottle cap 100 of the present disclosure. The method may include placing the reusable bottle cap 100 on a ground surface 30 such that the top surface 108 (shown in FIG. 1) of the panel 102 rests on the ground surface 30. The method may further include placing a golf ball (e.g., golf ball 20) on the peg 106 such that the golf ball is elevated above the ground surface 30. For example, when the panel 102 is resting on the ground surface 30, a distal end of the peg 106 is elevated above the ground surface 30 by about at least the height (e.g., distance H2) of the peg 106. In some embodiments, the golf ball 20 may be elevated above the ground surface 30, when placed on the peg 106, by at least 0.50 inches. In some embodiments, the distal end of the peg 106 is elevated above the ground surface 30 by about the total height H3 of the bottle cap 100. As such, the bottle cap 100 of the present disclosure may enable a user to repeatedly elevate a golf ball 20 placed thereon above a ground surface 30 by the same height each time. For example, and as opposed to conventional golf tees, the distal end 107 of the peg 106 is elevated above the ground surface 30 by generally the same height H3 each time the panel 102 rests on the ground surface.

Referring to FIGS. 1B and 2A, in some embodiments, the peg 106 includes a recess 105 for receiving at least a portion of the golf ball. The recess 105 may be located generally the bottom surface of the peg 106 and may have a shape corresponding to the generally spherical shape of a golf ball. For example, the recess 105 illustrated in FIGS. 1B and 2A has a generally frustoconical shape thereby allowing a portion of a golf ball to be received therein and abut the rim of the recess 105.

Referring back to FIG. 3, in some embodiments, the bottle cap 100 may include a plurality of teeth (not shown) configured to be inserted into a ground surface 30. The panel 102 may include a plurality of teeth extending upwardly from the top surface 108 of the panel 102 away from the peg 106. The plurality of teeth may be at least partially inserted into the ground surface 30 when the panel 102 rests on the ground surface 30. For example, when the bottle cap 100 is placed on the ground surface 30, a user may press the bottle cap 100 into the ground surface 30 causing the teeth to penetrate the ground surface 30 and be partially embedded therein. In this manner, the plurality of teeth extending outwardly from the top surface 108 of the panel 102 may provide increased stability and/or grip between the bottle cap 100 and the ground surface 30 when a golf ball 20 is placed thereon and struck by a player.

Figure 4A:
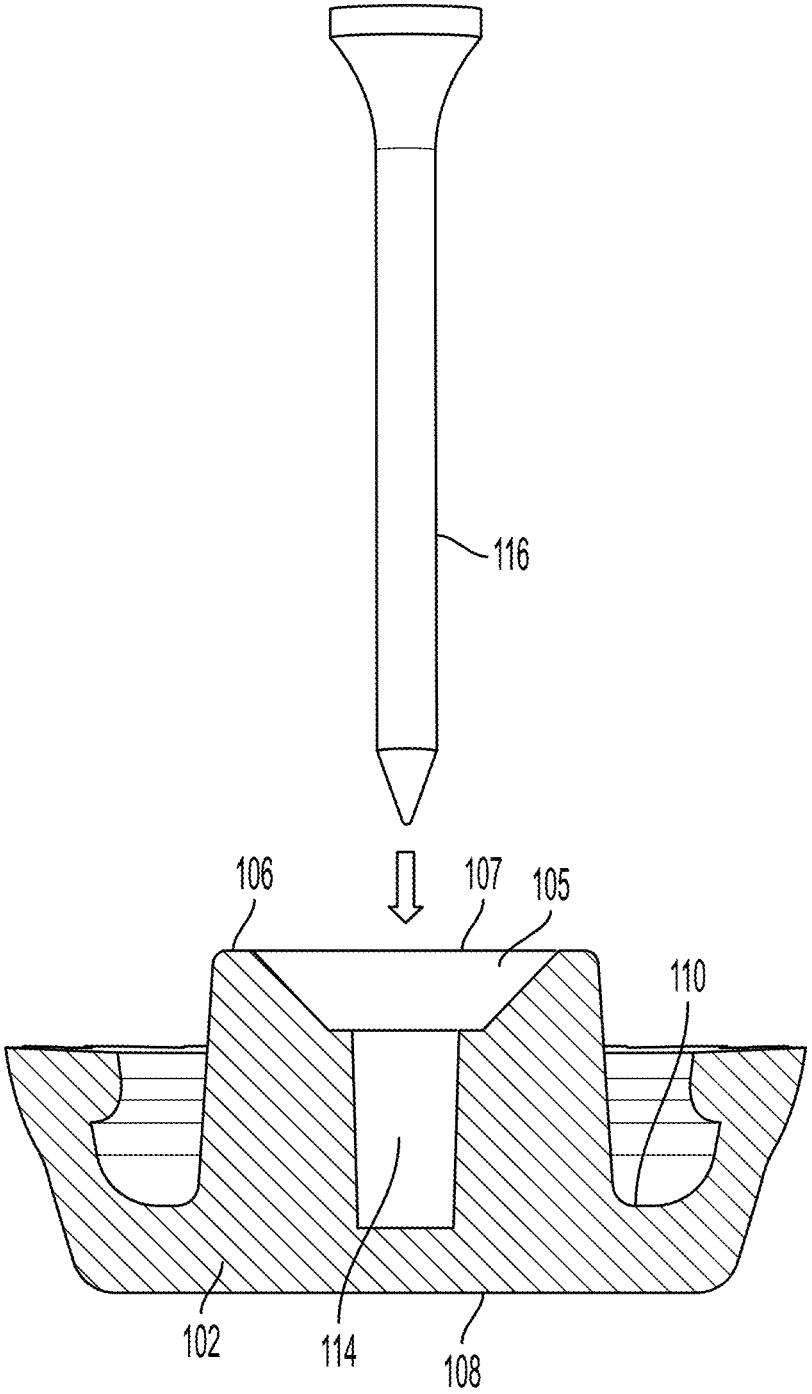
FIG. 4A is a cross-sectional view of the reusable bottle cap of FIG. 1A receiving a golf tee attachment.
Figure 4B:
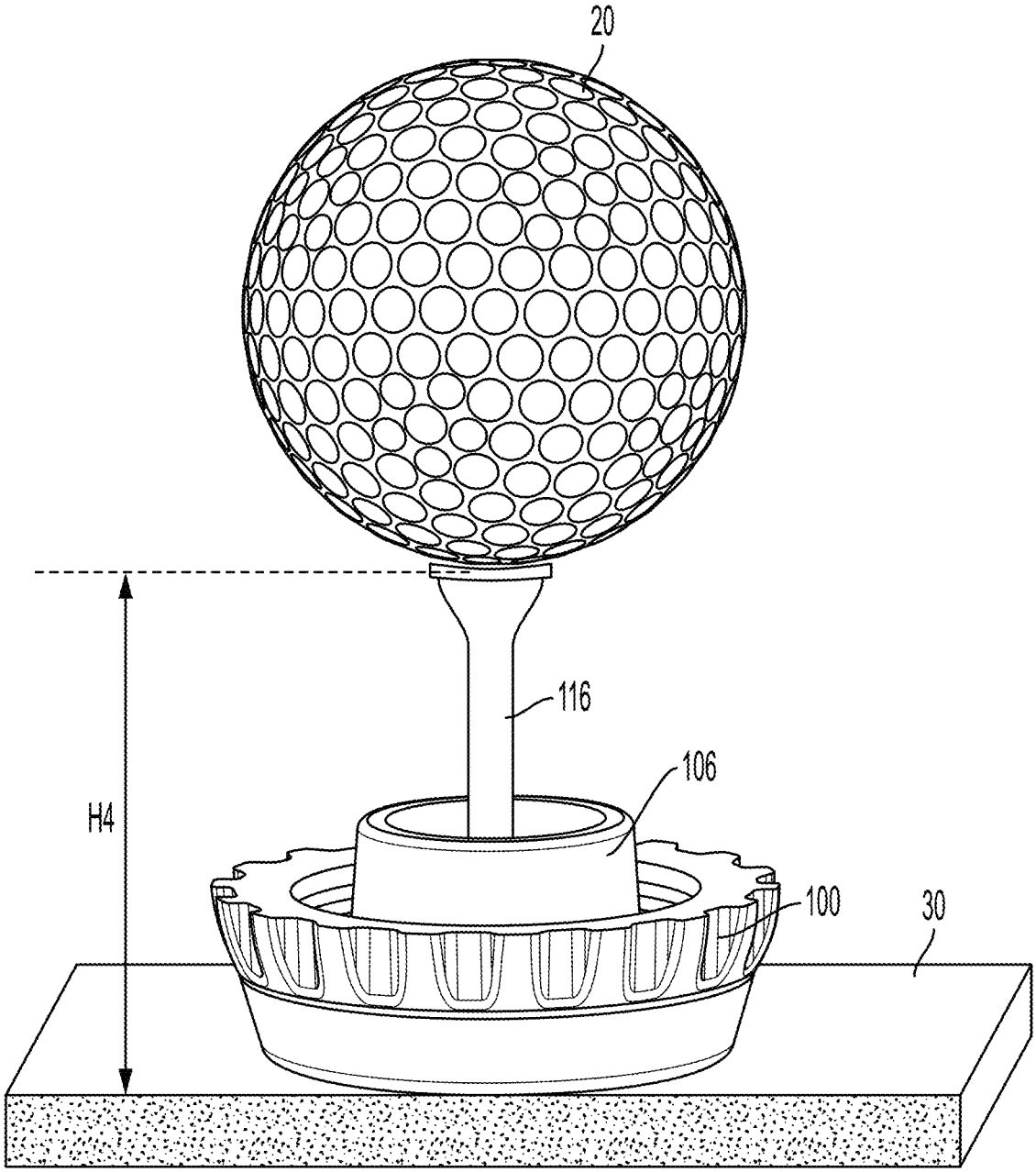
FIG. 4B is a perspective view of the reusable bottle cap of FIG. 1A with golf tee attachment coupled thereto and a golf ball resting on the golf tee attachment.

Referring to FIGS. 4A-4B, the bottle cap 100 may be configured to detachably receive one or more golf tee attachments or mounting structures to facilitate elevation of a golf ball above a ground surface at one or more different heights. In some embodiments, the peg 106 may include a receiving aperture 114 configured to detachably couple one or more golf tee attachments 116 to the reusable bottle cap 100. The receiving aperture 114 may be accessible at the distal end 107 of the peg 106 via the recess 105. For example, the aperture 114 may extend from the recess 105 at least partially towards the top surface 108 of the panel 102. The receiving aperture 114 may be sized and/or shaped corresponding to the one or more golf tee attachments 116 to be coupled thereto. For example, in FIG. 4A the receiving aperture 114 has a generally bowl shaped to match a corresponding shape of the golf tee attachment 116. As such, the receiving aperture 114 may detachably receive the golf tee attachment 116 therein. In some embodiments, the peg 106 may include one or more additional fastening means for securely coupling the golf tee attachment 116 thereto. For example, the golf tee attachment 116 may include a magnet embedded therein and the peg 106 may include a corresponding magnet embedded therein below the receiving aperture 114.

In other embodiments, the receiving aperture 114 may have a different shape and/or size than what is shown in FIG. 4A. For example, the receiving aperture 114 may be generally cylindrical in shape and extend downwardly from the distal end 107 of the peg 106 toward the top surface 108 of the panel 102. In some embodiments, the receiving aperture 114 may be sized and shaped to receive a conventional golf tee. For example, in some embodiments, the receiving aperture 114 may be a cylindrically shaped aperture having a diameter that is about equal to less than the diameter of a golf tee shaft. In such embodiments, the receiving aperture 114 may extend from the distal end 107 to the bottom surface 110 of the panel 102, or in other embodiments, to the top surface 108 of the panel 102. A single golf tee attachment 116 is shown in FIGS. 4A-4B, however there may be a plurality of different golf tee attachments configured to be detachably coupled to the peg 106 to facilitate different elevations of a golf ball placed thereon. For example, another golf tee attachment may be generally the same as the golf tee attachment 116 but be shorter or longer in length.

The golf tee attachment 116 when coupled to the peg 106 may enable a golf ball 20 placed thereon to be elevated above a ground surface by a distance H4 greater than when the golf ball 20 is placed on the peg 106 directly. For example, and as shown in FIG. 4B, the golf ball 20 is resting on the golf tee attachment 116 while the golf tee attachment 116 is coupled to the peg 106 such that the golf ball 20 is elevated above the ground surface by a distance H4. When compared to FIG. 3, it can be seen that the golf ball 20 is elevated above the ground surface 30 by a greater distance. The distance H4 may be greater than the distance H2 of the peg 106 and/or the total height H3 of the bottle cap 100. In some embodiments, the distance H4 may be at least twice the height H3.

Figure 5A:
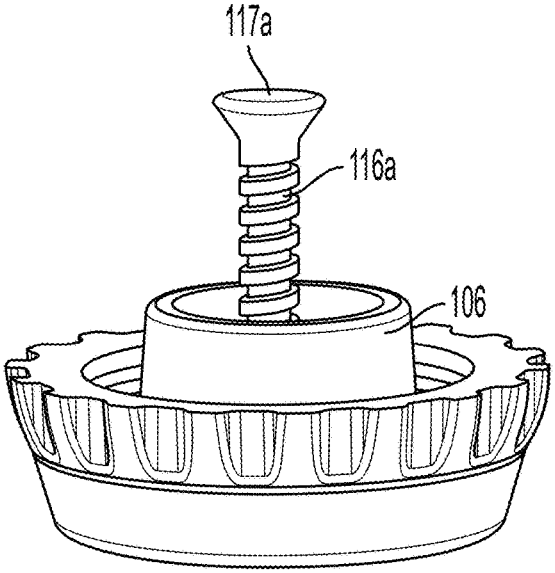
FIGS. 5A-5B are perspective views of a golf tee attachment in accordance with an exemplary embodiment of the present disclosure adjustably coupled to the bottle cap of FIG. 1A.
Figure 5B:
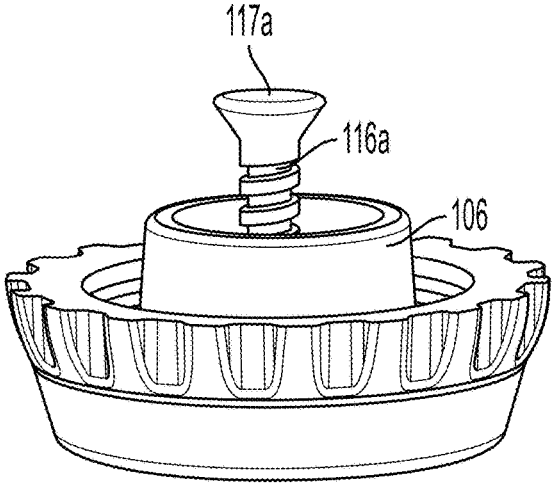
Figure 5C:
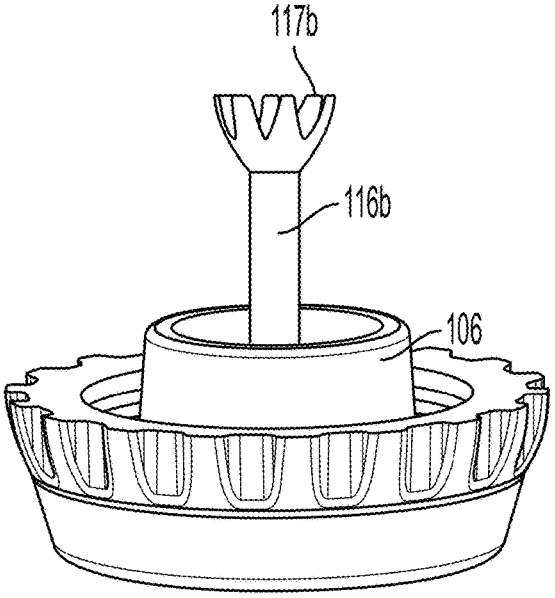
FIGS. 5C-5D are perspective views of another golf tee attachment in accordance with an exemplary embodiment of the present disclosure adjustably coupled to the bottle cap of FIG. 1A.
Figure 5D:
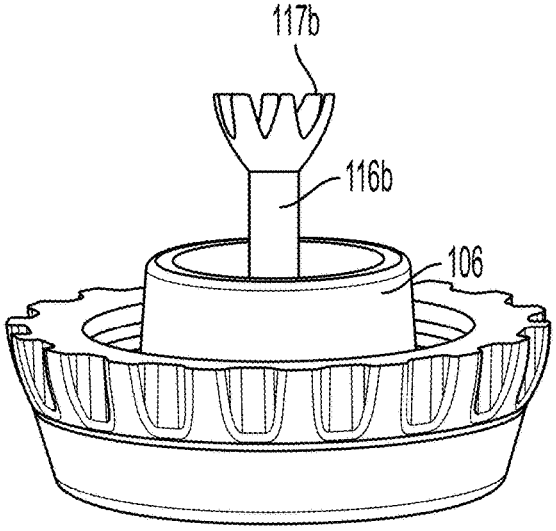

Referring to FIGS. 5A-5D, in some embodiments the peg 106 may be configured to receive an adjustable golf tee attachment 116*a*-116*b*. For example, and referring to FIGS. 5A-5B, the peg 106 is configured to receive a threaded golf tee attachment 116*a*. The aperture 114 (not shown) of the peg 106 may be threaded (e.g., includes corresponding grooves or teeth). As such, a user may rotate the threaded golf tee attachment 116*a* relative to the peg 106 thereby causing a distal end 117*a* of golf tee attachment 116*a* to translate towards or away from the peg 106. For example, and as illustrated in FIGS. 5A-5B the golf tee attachment 116*a* is rotated relative to the peg 106 causing the distal end 117*a* to translate towards the peg 106. Referring to FIGS. 5C-5D there is shown another embodiment of an adjustable golf tee attachment 116*b*. The aperture 114 (not shown) of the peg 106 may be configured to adjustably couple the golf tee attachment 116*b* thereto via a twist and lock coupling mechanism. For example, and as illustrated in FIGS. 5C-5D, the aperture 114 of peg 106 may be configured to enable a user to insert the golf tee attachment 116*b* therein to a desired height and rotate the golf tee attachment 116*b* relative to the peg 106 to cause the golf tee attachment 116*b* to be retained at the desired height.

In some embodiments, the peg 106 may be detachably coupled to the bottle cap 100. For example, in some embodiments, the panel 102 may include an aperture or receiving element configured to detachably couple the peg 106 thereto. In such embodiments, the peg 106 and/or golf tee attachment 116, 116*a*-116*b* may be configured to act as a divot tool when the peg 106 is decoupled from the bottle cap 100.

Figure 5E:
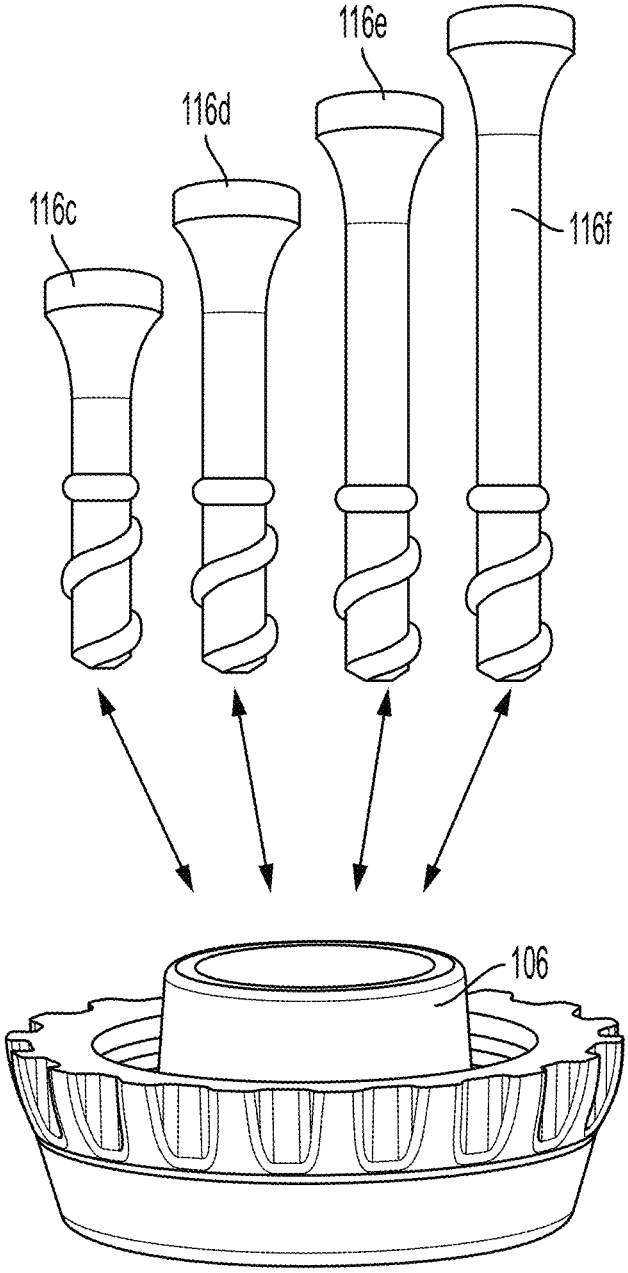
FIG. 5E is a perspective view of other golf tee attachments and a corresponding peg in accordance with an exemplary embodiment of the present disclosure.

Referring to FIG. 5E, in some embodiments, the peg 106 that may be configured to interchangeably receive a plurality of different golf tee attachments 116*c*-116*f*. The receiving aperture 114(not shown) of the peg 106 may be configured to interchangeably couple the golf tee attachments 116*c*-116*f* thereto. For example, any one of the golf tee attachments 116*c*-116*f* may be selectively inserted into the receiving aperture 114 by a user thereby coupling the selected golf tee attachment 116*c*-116*f* to the peg 106. In some embodiments, the golf tee attachments 116*c*-116*f* include a threaded distal portion configured to interface with a corresponding threaded inner sidewall of the receiving aperture 114. The golf tee attachments 116*c*-116*f* may be generally the same as one another except that each may be a different length. For example, and as illustrated in FIG. 5E, golf tee attachment 116*c* has a lesser length than golf tee attachment 116*d*, which has a lesser length than golf tee attachment 116*e* and so on. By providing a receiving aperture 114*c* configured to detachably receive a plurality of different golf tee attachments 116*c*-116*f*, the peg 106 may allow a user to elevate a golf ball placed thereon at a plurality of distances above the ground surface.

By providing the bottle cap 100 configured to receive a plurality of different adjustable and/or interchangeable golf tee attachments, the bottle cap 100 of the present disclosure may enable a user to elevate a golf ball placed thereon to a desired height. For example, each of the golf tee attachments 116*a*-116*f* discussed above with reference to FIGS. 5A-5E may be used in combination with the bottle cap 100 by a user to elevate a golf ball to a desired height for striking the golf ball. As such, the bottle cap 100 of the present disclosure may be particularly beneficial in instances where the length of a conventional golf tee would elevate a golf ball less than the user's desired height resulting in the potential flight distance of the golf ball being impeded.

Figure 6A:
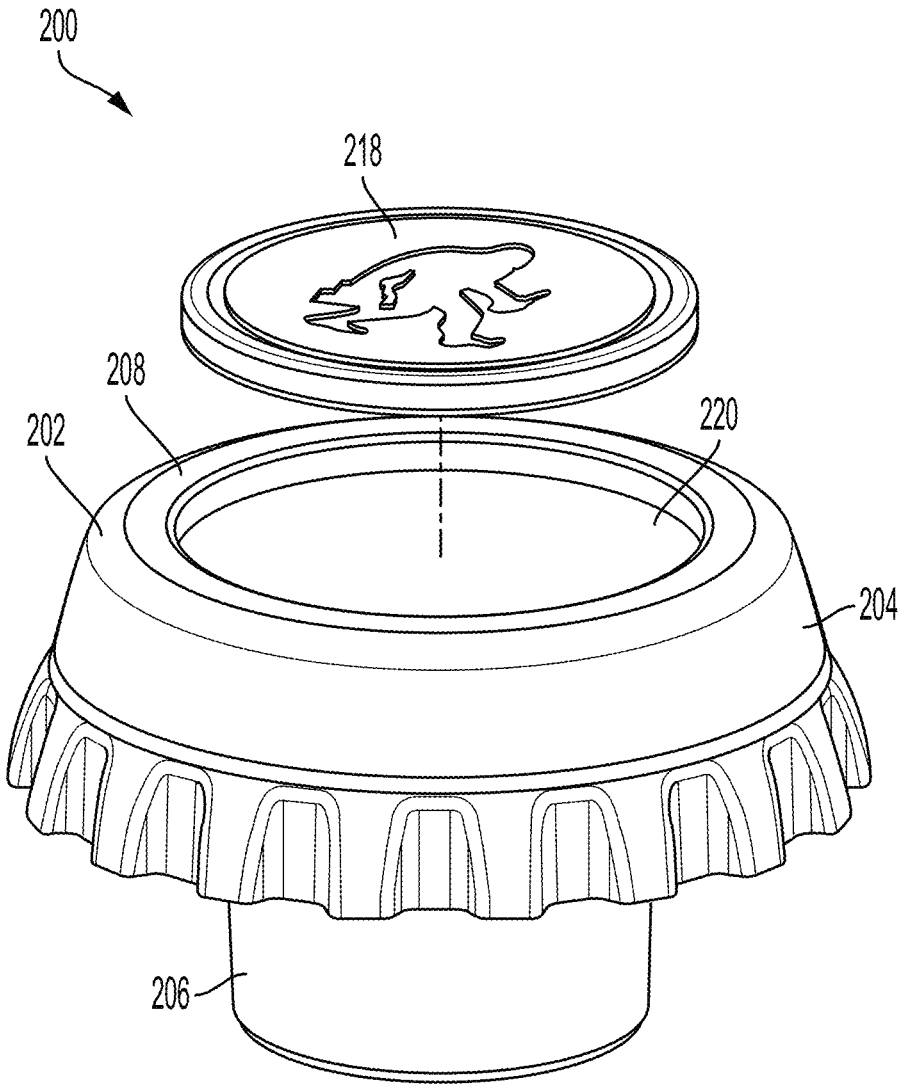
FIG. 6A is a top perspective view of a reusable bottle cap in accordance with another exemplary embodiment of the present disclosure.
Figure 6B:
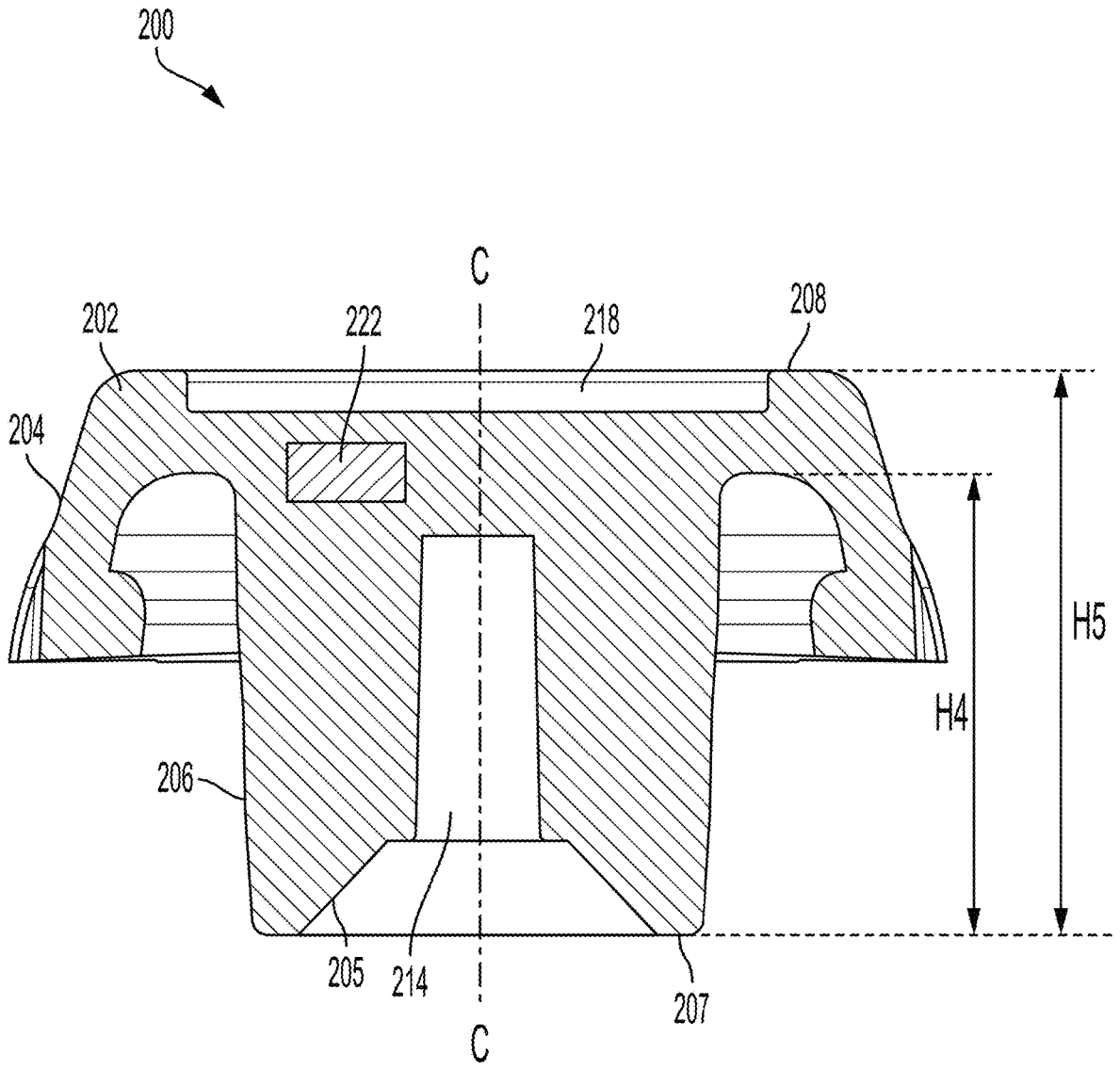
FIG. 6B is a side cross-sectional view of the reusable bottle cap of FIG. 6A.

Referring to FIGS. 6A-6B, there is shown another embodiment of a reusable bottle cap, generally designated 200, in accordance with an exemplary embodiment of the present disclosure. The bottle cap 200 may be generally the same as bottle cap 100 except that it may include a detachable ball marker 218 and/or a peg 206 that is longer than peg 106. The peg 206 may be generally the same as peg 106 except that it may have a height H4 that is greater than the height H2 of the peg 106. In some embodiments, the height H4 of the peg 206 is about 0.575 inches. The peg 206 may include a recess 205 open at a distal end 207 of the peg 206 and generally the same as recess 105. For example, the recess 205 may receive a portion of a golf ball in generally the same manner as discussed above and as illustrated in FIG. 3. In some embodiments, the peg 206 includes an aperture 214 open at the recess 205 and configured to receive a golf tee attachment (e.g., attachment 116) in generally the same manner as the aperture 114 discussed above. The bottle cap 200 may have a total height H5 that is greater than the total height H3 of the bottle cap 100. In some embodiments, the total height H5 is between about 0.50 inches to about 1.00 inches. In some embodiments, the total height H5 is about 0.75 inches.

In some embodiments, the bottle cap 200 includes a golf ball marker 218 detachably coupled thereto. The panel 202 may include a recess 220 positioned at the top surface 208 thereof for detachably receiving a golf ball marker 218 and a magnet 222 configured to retain the golf ball marker 218 within the recess 220. In some embodiments, the magnet 222 is positioned between the top surface 208 of the panel 202 and the distal end 207 of the peg 206. For example, the golf ball marker 218 may be comprised of a metal material that is magnetically attracted to the magnet 222. As such, when the golf ball marker 218 is placed within the recess 220, the magnet 222 may apply a magnetic force to the golf ball marker 218 such that the marker 218 is prevented from being accidentally or unintentionally removed from the recess 220. In some embodiments, the strength of the magnet 222 is selected such that the golf ball marker 218 may be manually removed from the panel 202 by a user. By providing the bottle cap 200 with detachable golf ball marker 218, a user may couple the bottle cap 200 to a bottle (e.g., as shown and discussed above with regards to FIG. 2B) and remove the golf ball marker 218 therefrom to mark the position of their golf ball (e.g., the golf ball position on a putting green). As such, the bottle cap 200 may enable a user to fluidly seal their bottle while being able to simultaneously user the golf ball marker 218 as desired.

In some embodiments, the magnet 222 may enable a user to magnetically couple the bottle cap 200 to a metallic surface. In some embodiments, the magnet 218 may be a weighted magnet positioned between a golf ball 20 and the ground surface 30 when the golf ball 20 is placed on the peg 206 and/or a golf tee attachment coupled thereto. In some embodiments, the magnet 218 is configured to reduce displacement of the bottle cap 200 in an instance where the bottle cap 200 is struck by a player with a golf club. For example, in an instance where the bottle cap 200 is struck by the metallic golf club head, a magnetic attraction between the golf club head and magnet may increase thereby reducing the inertia of the bottle cap 200. The magnet 222 may be embedded within the panel 202 and/or a portion of the peg 206 and may be offset from the central axis C of the bottle cap 200. In some embodiments, the magnet 222 is a permanent magnet. In some embodiments, the recess for detachably receiving the golf ball marker 203 may include upper and lower stepped surfaces (not shown) such that the magnet 222 may retain the golf ball marker 218 on the upper stepped surface and a user may press downwardly on the portion of the golf ball marker 218 above the lower stepped surface thereby causing the golf ball marker 218 to pivot and be easily removed from the recess. In some embodiments, the bottle cap 100 may also include a golf ball marker, magnet, and/or recess at the top surface 108 of the panel 102 generally the same as the marker 218, recess 220 and magnet 222. In some embodiments, the bottle cap 100 and/or bottle cap 200 may include a divot tool detachably coupled thereto. For example, the recess 220 may be configured to detachably receive a divot tool (not shown).

Figure 7A:
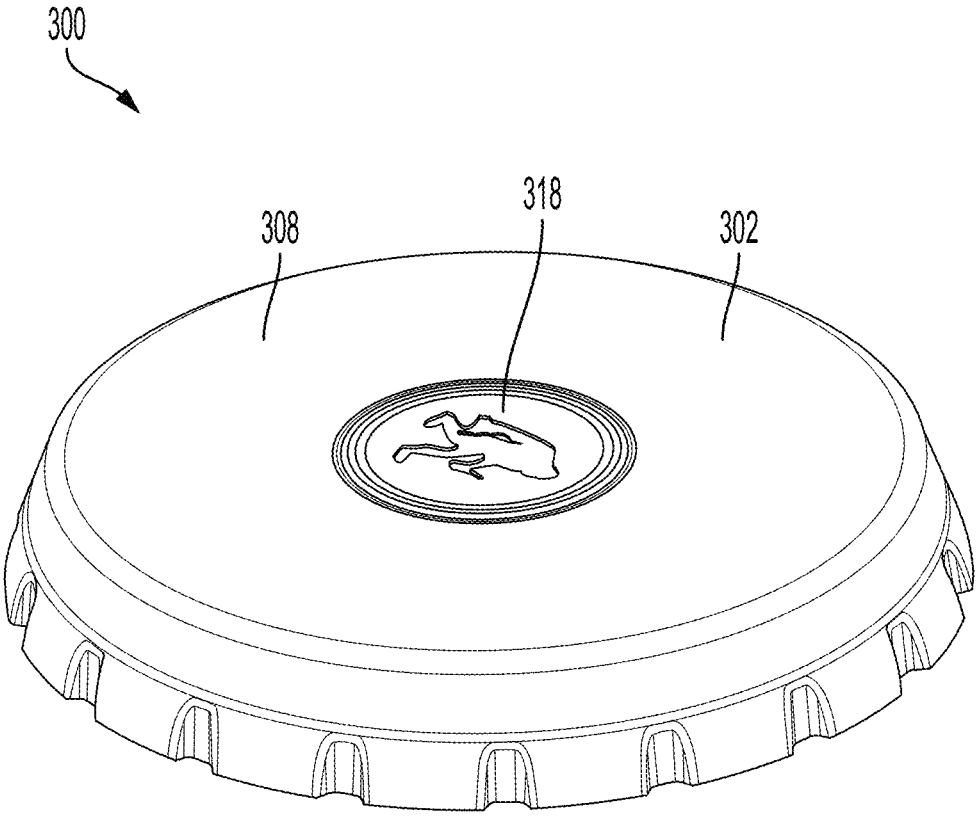
FIG. 7A is a top perspective view of a reusable bottle cap in accordance with another exemplary embodiment of the present disclosure.
Figure 7B:
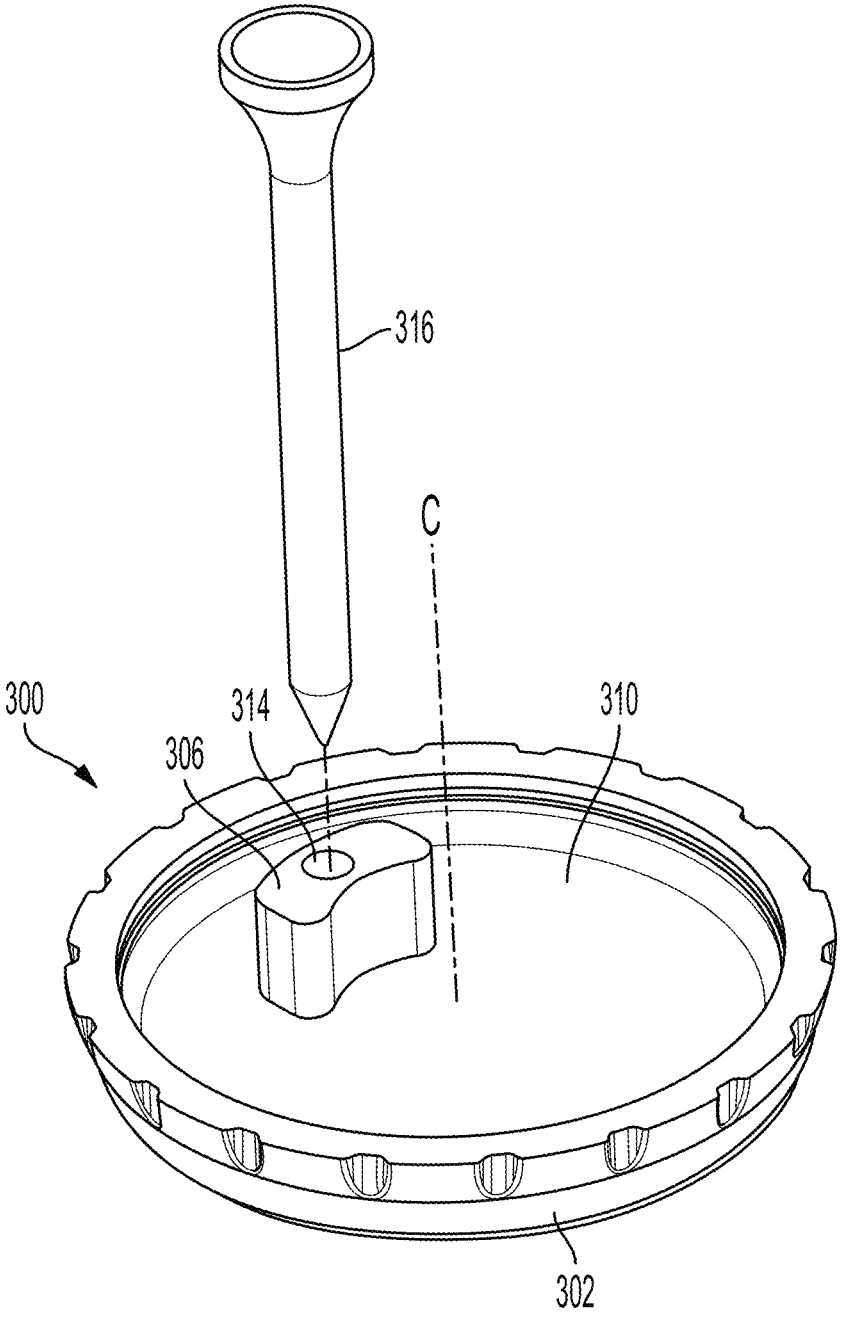
FIG. 7B is a bottom perspective view of the reusable bottle cap of FIG. 7A with a golf tee attachment.
Figure 7C:
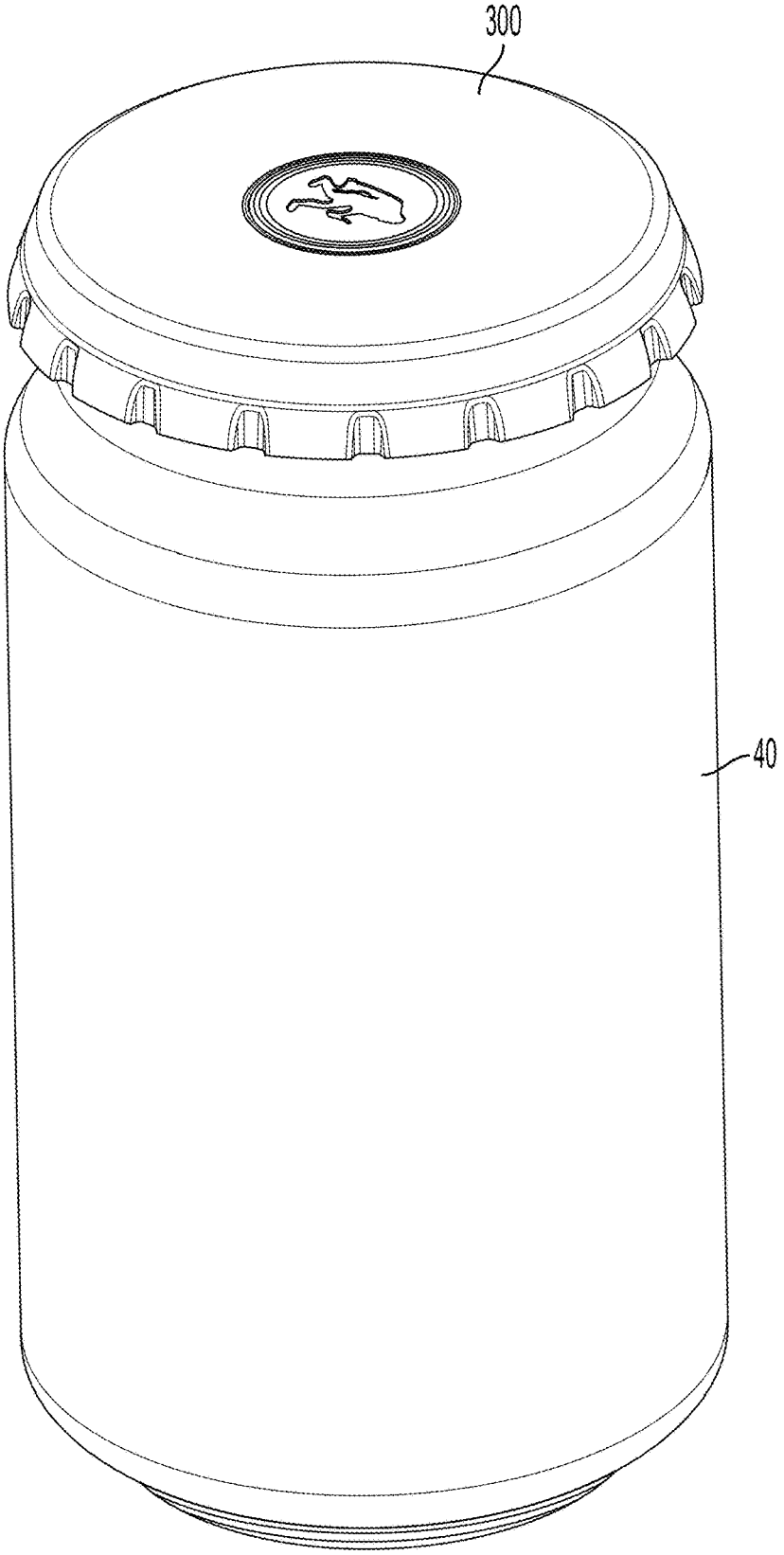
FIG. 7C is a perspective view of the reusable bottle cap of FIG. 7A coupled to a pull-tab can.

Referring to FIGS. 7A-7C there is shown a reusable bottle cap, generally designated 300, in accordance with another exemplary embodiment of the present disclosure. The bottle cap 300 may be generally the same as bottle caps 100 and/or 200 discussed above except that the bottle cap 300 may be configured to be coupled to a pull-tab can 40 (e.g., as illustrated in FIG. 7C). For example, the bottle cap 300 may be sized to engage with the rim (not shown) of the pull-tab can 40 such that the bottle cap 300 may act as a fluid seal when coupled thereto. The bottle cap 300 may include a peg 306 similar to the same as peg 106 except that the peg 306 may be shaped to be received within the mouth of a pull-tab can 40. In some embodiments, the peg 306 is positioned along a bottom surface 310 of the panel 302 such that it may extend into the mouth of a pull-tab can 40 when coupled thereto.

For example, in pull-tab cans, the mouth is offset from a central axis of the can 40 and as such, the peg 306 may be offset from the central axis C of the panel 302. The peg 306 may include an aperture 314 configured to receive a golf tee attachment 316 in generally the same manner as the aperture 114 discussed above. As illustrated in FIG. 7B, the peg 306 may not include a recess similar to the recess 105 for receiving a golf ball directly on the peg 306. However, in other embodiments, the peg 306 may include a generally frustoconical shaped recess that is generally the same as recess 105.

In some embodiments, the bottle cap 300 includes a golf ball marker 318 that is generally the same as golf ball marker 218. The golf ball marker 318 may be detachably coupled to the top surface 308 of the panel 302 in generally the same manner as golf ball marker 218 discussed above. For example, the panel 302 may define a recess 320 accessible at the top surface 308 of the panel 302 and a permanent magnet (not shown) embedded within the panel 302 between the top and bottom surfaces 308, 310 thereof.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "right", "left", "lower" and "upper" designate directions in the drawings to which reference is made. Unless specifically set forth herein, the terms "a", "an" and "the" are not limited to one element but instead should be read as meaning "at least one". As used herein, the term "about" may refer to +/−10% of the value referenced. For example, "about 9" is understood to encompass 8.1 and 9.9.

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

What is claimed is:

1. A reusable bottle cap comprising:

a panel having a top surface and a bottom surface;

a sidewall extending downwardly from a periphery of the panel away from the bottom surface, the sidewall configured to engage with an outer surface of a bottle neck proximate a rim of the bottle when the reusable bottle cap is coupled to the bottle neck;

a peg extending downwardly from the bottom surface of the panel and spaced from the sidewall and including a distal end with a receiving aperture extending therefrom towards the panel, the peg configured to be spaced from an inner surface of the bottle neck when the reusable bottle cap is coupled to the bottle neck; and a golf tee attachment positioned within the receiving aperture such that the golf tee attachment is detachably coupled to the peg.

2. The reusable bottle cap of claim 1, wherein the sidewall extends downwardly from the bottom surface of the panel by a first distance and the peg extends downwardly from the bottom surface of the panel by a second distance that is greater than the first distance.

3. The reusable bottle cap of claim 2, wherein the first distance is about 0.375 inches, and the second distance is about 0.535 inches.

4. The reusable bottle cap of claim 1, wherein the panel extends circumferentially around a central axis and the peg extends downwardly from the bottom surface of the panel along the central axis.

5. The reusable bottle cap of claim 1, wherein the peg has an outer diameter that is less than an inner diameter of the sidewall.

6. The reusable bottle cap of claim 1 wherein the peg has an outer diameter that is equal to about 75% of an inner diameter of the sidewall.

7. The reusable bottle cap of claim 1, wherein the peg is configured to receive a golf ball as a golf tee when the panel is placed on a ground surface such that the golf ball does not directly contact the sidewall.

8. The reusable bottle cap of claim 1, wherein the receiving aperture is configured to interchangeably couple a plurality of different golf tee attachments to the peg.

9. The reusable bottle cap of claim 1, wherein the panel, sidewall and peg are comprised of a generally flexible material.

10. The reusable bottle cap of claim 1, wherein the sidewall and peg form a bottle opener.

11. The reusable bottle cap of claim 1, wherein the peg includes a generally frustoconical recess at the distal end of the peg and configured to receive a portion of a golf ball.

12. The reusable bottle cap of claim 1 further comprising:

a magnet fixedly coupled to the panel, the magnet configured to detachably couple the reusable bottle cap to a metallic surface.

13. The reusable bottle cap of claim 12 further comprising:

a golf ball marker detachably coupled to a recess at the top surface the panel by the magnet.

14. The reusable bottle cap of claim 13, wherein the panel extends circumferentially around a central axis and the magnet is embedded within the panel and offset from the central axis.

15. The reusable bottle cap of claim 1, wherein the golf tee attachment is adjustably coupled to the receiving aperture such that, while positioned within the receiving aperture, a height from a distal end of the golf tee attachment to the peg is adjustable to a desired height, and wherein the receiving aperture is configured to retain the golf tee attachment at the desired height.

16. A reusable bottle cap comprising:

a panel having a top surface defining a first recess and a bottom surface opposite the top surface;

a ball marker detachably received within the first recess at the top surface of the panel and magnetically coupled thereto via a magnet embedded in the panel;

a sidewall extending downwardly from a periphery of the panel away from the bottom surface, the sidewall configured to engage with an outer surface of a bottle neck proximate a rim of the bottle when the reusable bottle cap is coupled to the bottle neck;

a peg extending downwardly from the bottom surface of the panel and spaced from the sidewall, an outer surface of the peg spaced from an inner surface of the sidewall, the peg including a generally frustoconical recess open at a distal end of the peg and configured to receive a golf ball, and a receiving aperture open at the recess of the peg and extending upwardly toward the top surface of the panel; and a golf tee attachment positioned within the receiving aperture such that the golf tee attachment is detachably coupled to the peg.

17. A method of placing a golf ball on a tee, the method comprising:

placing a reusable bottle cap on a ground surface, the reusable bottle cap comprising:

a panel having a top surface and a bottom surface;

a sidewall extending downwardly from a periphery of the panel away from the bottom surface, the sidewall configured to engage with an outer surface of a bottle neck proximate a rim of the bottle when the reusable bottle cap is coupled to the bottle neck; and a peg extending downwardly from the bottom surface of the panel and spaced from the sidewall, the peg configured to be spaced from an inner surface of the bottle neck when the reusable bottle cap is coupled to the bottle neck; and placing a golf ball on the peg such that the golf ball is elevated above the ground surface by at least 0.50 inches, wherein when placed on the ground surface the top surface of the panel rests on the ground surface.

18. The method of claim 17, wherein placing the golf ball on the peg further includes inserting a golf tee attachment into a receiving aperture to couple the golf tee attachment to the peg and placing the golf ball on the golf tee attachment such that the golf ball is elevated above the ground surface.

19. The method of claim 17 further comprising:

prior to placing the reusable bottle cap on the ground surface, removing the reusable bottle cap from the mouth of a bottle; and following placing the golf ball on the peg, reattaching the reusable bottle cap to the mouth of the bottle such that a fluid seal is formed between the reusable bottle cap and bottle.

20. The method of claim 17, wherein the peg includes a generally frustoconical recess at a distal end of the peg and placing the golf ball on the peg includes placing the golf ball within the recess at the distal end of the peg.

* * * * *